United States Patent [19]

Everson

[11] 4,121,379

[45] Oct. 24, 1978

[54] MODULAR STORM WINDOW

[75] Inventor: William Everson, Perkasie, Pa.

[73] Assignee: Perkasie Industries Corporation, Perkasie, Pa.

[21] Appl. No.: 687,878

[22] Filed: May 19, 1976

[51] Int. Cl.[2] ..... E05B 65/04

[52] U.S. Cl. ..... 49/61; 49/463; 52/202

[58] Field of Search ..... 49/62, 61, 463, 465, 49/466; 52/202, 203; 160/369, 368

[56] References Cited

U.S. PATENT DOCUMENTS

| | | | |
|---|---|---|---|
| 2,221,005 | 11/1940 | Reese | 49/61 X |
| 2,379,601 | 7/1945 | Smith | 49/61 |
| 2,723,732 | 11/1955 | Pettersen | 49/463 X |
| 3,009,515 | 11/1961 | Albee, Jr. | 160/369 |
| 3,024,837 | 3/1962 | McPhail | 49/61 X |
| 3,251,399 | 5/1966 | Grossman | 160/368 R X |
| 3,283,804 | 11/1966 | Yancey | 160/368 R X |

*Primary Examiner*—Philip C. Kannan

*Attorney, Agent, or Firm*—Woodcock, Washburn, Kurtz & Mackiewicz

[57] ABSTRACT

An auxiliary or storm window is attached to the inside of window frames. Transparent acrylic panels having lengths which exceed the transverse dimension of the frames and widths which are less than the longitudinal dimension of the frame are cut to fit the inside frame of the window. Elongated frame members having longitudinal slots which engage the edges of the panels are positioned on the sides and on the top of the panels. Track members join adjacent panels along their length to form a sheet of panels of the correct size. Each track member has a flat longitudinal surface which is fastened across the frame between adjacent panels. It has an upwardly facing slot to engage the panel above the track and a downwardly facing slot in which a gasket is placed to seal the track member to the top frame of the panel below it.

5 Claims, 10 Drawing Figures

Fig. 2
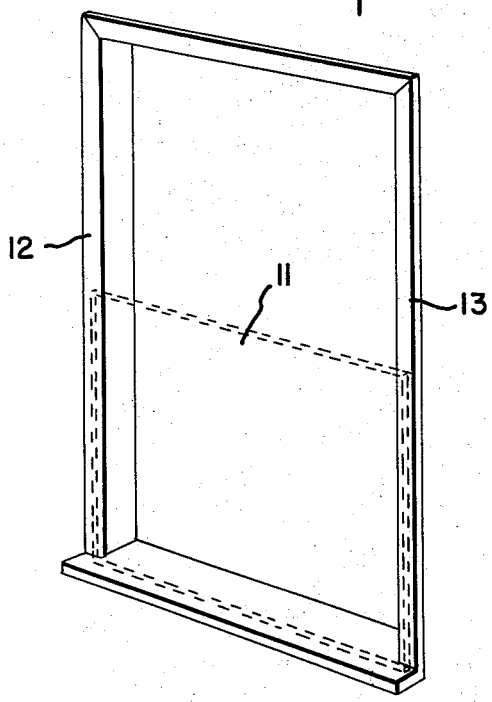
Fig. 4
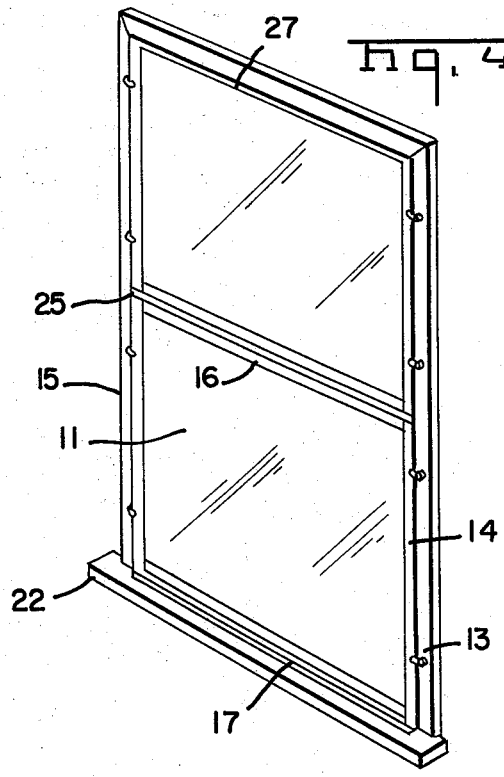
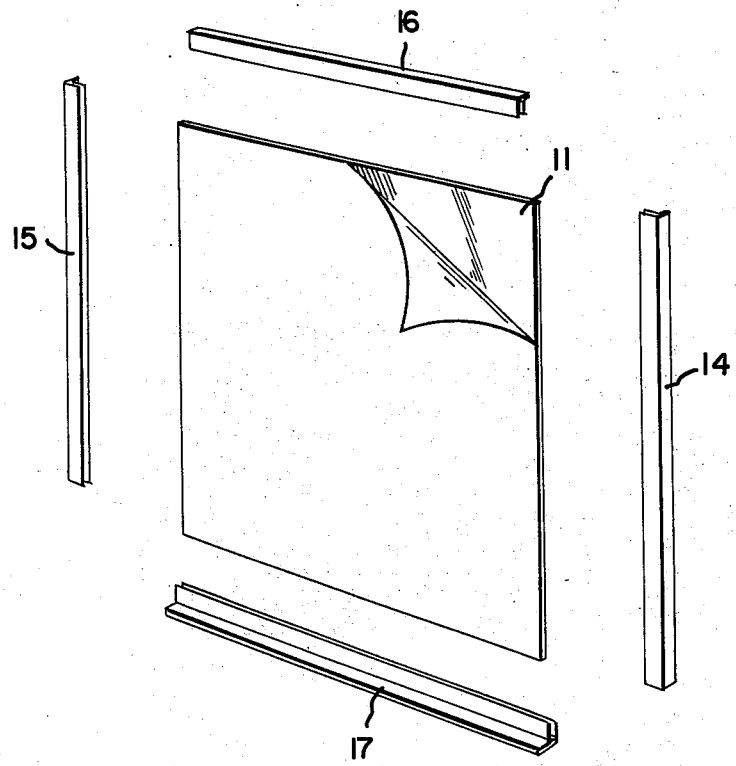
Fig. 3

Fig. 5
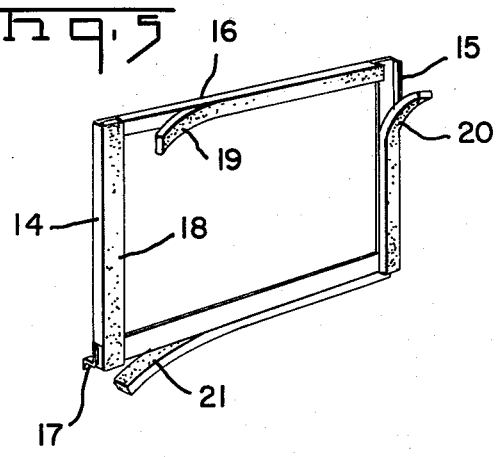
Fig. 6
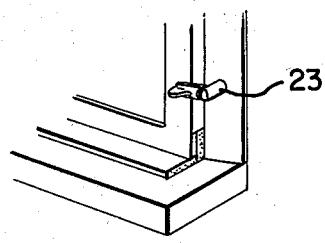
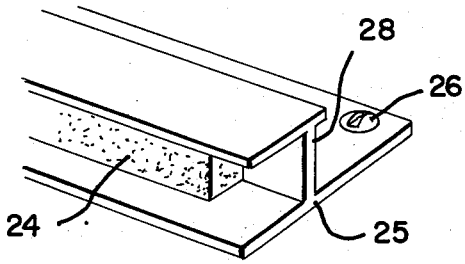
Fig. 7
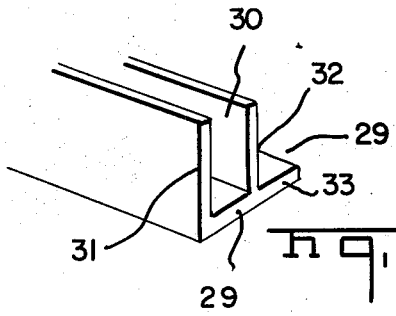
Fig. 8
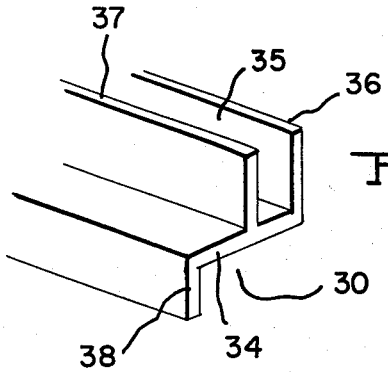
Fig. 9

MODULAR STORM WINDOW

BACKGROUND OF THE INVENTION

This invention relates to auxiliary or storm windows and more particularly to a window which can be inexpensively installed on the inside of the window frame.

Escape of heated air through broken window panes, and cracks around panes and by conduction through single pane windows is a severe problem, particularly in older houses. Weatherizing these windows is particularly difficult because until the late 1940's there was no standardization of window size. Windows in older houses are wide and low, narrow and high. Some operate up and down, some left or right, some open out and some open in. To aggravate the problem still further, it has been estimated that approximately 75% of the windows in these older houses are out of square.

A long-life, efficient, flexible and reasonably priced window is required for installation on these older homes. The prior art window weatherization techniques have not been completely satisfactory. Clear plastic film has been used because it is inexpensive and easy to install. This film has a very short life, low efficiency, poor appearance and the window cannot thereafter be operated without destroying the film. Plastic panels also have been permanently installed on windows. These have the advantage of inexpensive installation and provide good efficiency. However, they cannot be operated. Also, there is a high waste factor in installation because a full plastic sheet must normally be used in weatherizing one window.

Glass storm windows have been in use for a number of years. They are very expensive, dangerous, provide only average efficiency and present installation problems, particularly where they must be custom made to fit odd shaped windows. One such storm window is illustrated in U.S. Pat. No. 2,745,485 to Etling. Etling discloses a storm window which may be adapted to window casings of various dimensions, however these storm windows are placed within rather than over the window casing, thus requiring the installer to fit the window to rather precise dimensions.

SUMMARY OF THE INVENTION

The auxiliary closure of this invention can be installed inexpensively and quickly on the inside of the frame of a window. It includes a transparent acrylic plastic panel with frame members and a sill member which engage the edges of the panel. Gaskets between the frame members and the window frame and between the sill member and the window sill sealingly engage the auxiliary closure with the window frame. Locking means are provided to secure the panel assembly to the window frame. The locking means can be easily operated so that the closure can be simply removed when it is desired to open the window.

In accordance with an important aspect of the invention, the auxiliary closure can be inexpensively and quickly installed on windows of various different sizes. The auxiliary window includes transparent acrylic plastic panels which are provided in a limited number of sizes having lengths which exceed the transverse dimension of window frames on which they are to be installed and having widths which are generally less than the longitudinal dimension of the frames. In order to install the window, the correct length which just exceeds the transverse dimension of the frame is selected. A combination of panels is selected with a combined width greater than the longitudinal dimension of the frame. If necessary, the panels are cut to the correct size.

Frame members having slots which engage the edges of the panels are installed on the sides and on the top of each panel. A frame is also installed on the top of the topmost panel. A sill member is similarly installed on the bottom of the bottom panel. The frames and the sill member have slots for receiving gaskets which seal the frame members and the sill member to the frames and sill of the window on which the installation is being carried out.

Track members are fastened across the frame between the panels. The track members have an upwardly facing slot for engaging the edge of the panel above the track and a downwardly facing slot into which a gasket is inserted to seal the track to the top frame of the transparent panel below it.

The completed window closure has a reasonable cost, high efficiency, excellent appearance and long life. The window systems are substantially maintenance free, safe, can be opened and closed at will, have high resistance to impact and are flexible enough to be installed on all types of windows.

The foregoing and other objects, features and advantages of the invention will be better understood from the following more detailed description and appended claims.

DESCRIPTION OF THE DRAWINGS

FIG. 2 shows a window frame with a single transparent panel cut to the correct size;

FIG. 3 depicts the frame and sill members for the transparent panel;

FIG. 4 shows a completed two-panel installation;

FIG. 5 shows the installation of gaskets;

FIG. 6 shows the lower corner of a panel;

FIG. 7 shows a portion of a track member;

FIG. 8 shows a portion of a frame member;

FIG. 9 shows a portion of the sill member; and

DESCRIPTION OF THE PREFERRED EMBODIMENT

Figure 1:
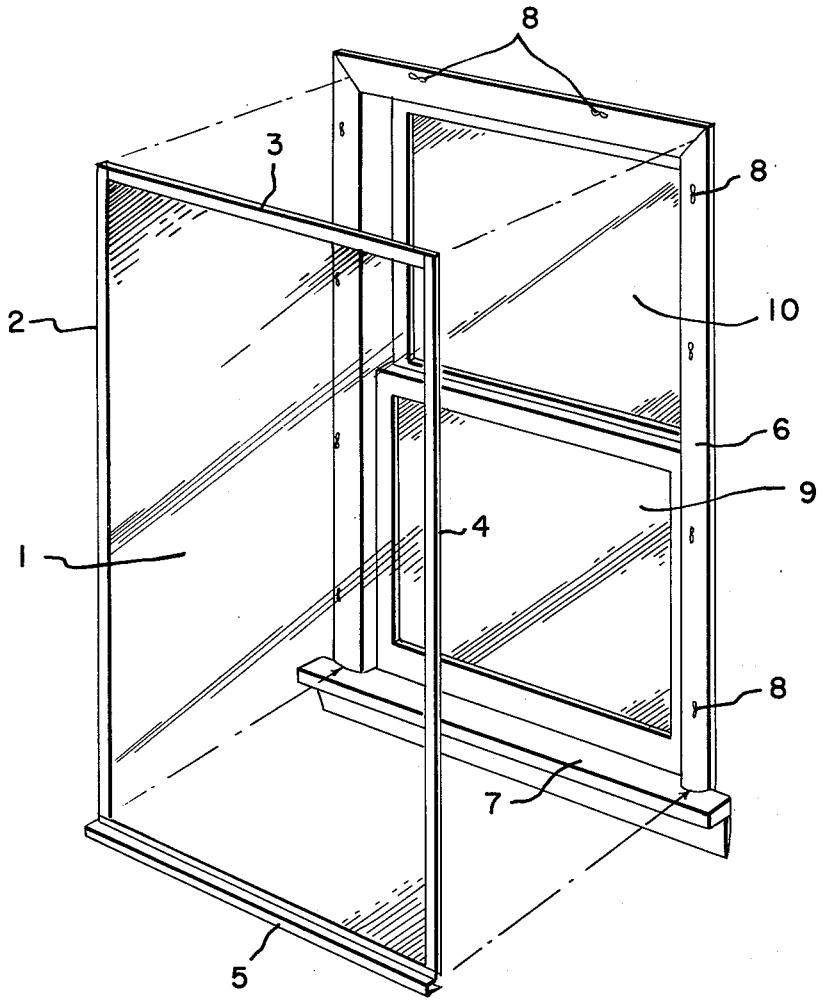
FIG. 1 shows a one piece auxiliarly closure for a window frame.

In FIG. 1, a single hard acrylic transparent plastic panel 1 forms the closure. Frame members 2–4 have slots which engage the edges of the sides and the top of the panel. A sill member 5 has an upwardly facing slot which engages the bottom edge of the panel. The width and length of the panel exceed the transverse and longitudinal dimensions of the window so that the assembly can be placed against the inside of the frame 6 with the sill member 5 resting on the window sill 7. Gaskets seal the auxiliary closure to the window frame and sill. A plurality of turn locks, such as the one indicated at 8, are provided to lock the auxiliary closure to the frame. By manipulating these turn locks, the auxiliary window can be easily removed when it is desired to open the windows 9 and 10.

In accordance with an important feature of this invention, a limited number of different size panels may be used to provide window closures for a large number of different window sizes. The correct size of hard acrylic transparent plastic panel is selected for the appropriate window dimensions from a limited number of panel sizes which are available. As an example, panels having widths of 30, 34, 38, 42 and 46 inches and heights of 46, 56, 66, 69, 79, 89 and 99 inches are provided. These different sizes of panels are usually sufficient to accommodate all window sizes which will be encountered.

The remaining figures show the use of more than one panel to provide a closure for windows of different sizes.

If necessary, the panel 11, shown in FIG. 2, can be cut so that the panel overlaps both sides 12 and 13 of the finish flange by at least ½ to 1 inch.

FIG. 3 depicts the film being removed from the panel 11. Frame members 14–16 having longitudinal slots are installed on the edges of the side and top of panel 11. A sill member 17 having an upwardly facing slot is installed on the bottom edge of the panel.

The completed assembly is placed upright on the window sill 22 as shown in FIG. 4. As shown in FIG. 5, gaskets 18–21 are installed in slots in the frame members 14–16 and in the sill member 17. Turn locks including the lock 23 (FIG. 6) secure the assembly to the window frame.

A track member 25, shown in more detail in FIG. 7, is installed across the top of the assembly. A gasket 24 is placed in the downwardly facing slot of a track member 25. The track member 25 has a generally flat longitudinal surface which is placed across the frame and fastened to the frame by screw 26. Track member 25 has an upwardly facing slot 28 which receives the sill of a panel assembly installed above it. Installation is accomplished by loosening the top turn locks of the installed panel and slipping the track member 25 in behind the gasketing of the panel. Application of slight downward pressure creates a good seal between the gasket 24 in the bottom of the track member and the top frame member 16 of the transparent panel below it. Another transparent panel is framed and installed in a similar manner. The completed installation for a two-panel window is shown in FIG. 4.

While a gasket 19 has been shown in FIG. 5 installed in the frame 16, normally a gasket will be installed only along the frame 27 at the top of the uppermost panel that finishes out the window.

FIG. 8 shows the frame member which has a longitudinal base 29, a longitudinal portion of which defines the bottom of the slot 30. Walls 31 and 32 define the sides of the slot. A gasket is placed against the other side of wall 32. The portion 33 of the base defines a lip which extends over the gasket.

The sill member shown in FIG. 9 includes a longitudinal base 34, a portion of which defines the bottom of the slot 35. Walls 36 and 37, which extend from one side of the base 34, define the sides of the slot. The gasket is placed against the other side of base 34. A lip 38 encloses the outside of the gasket.

Figure 10:
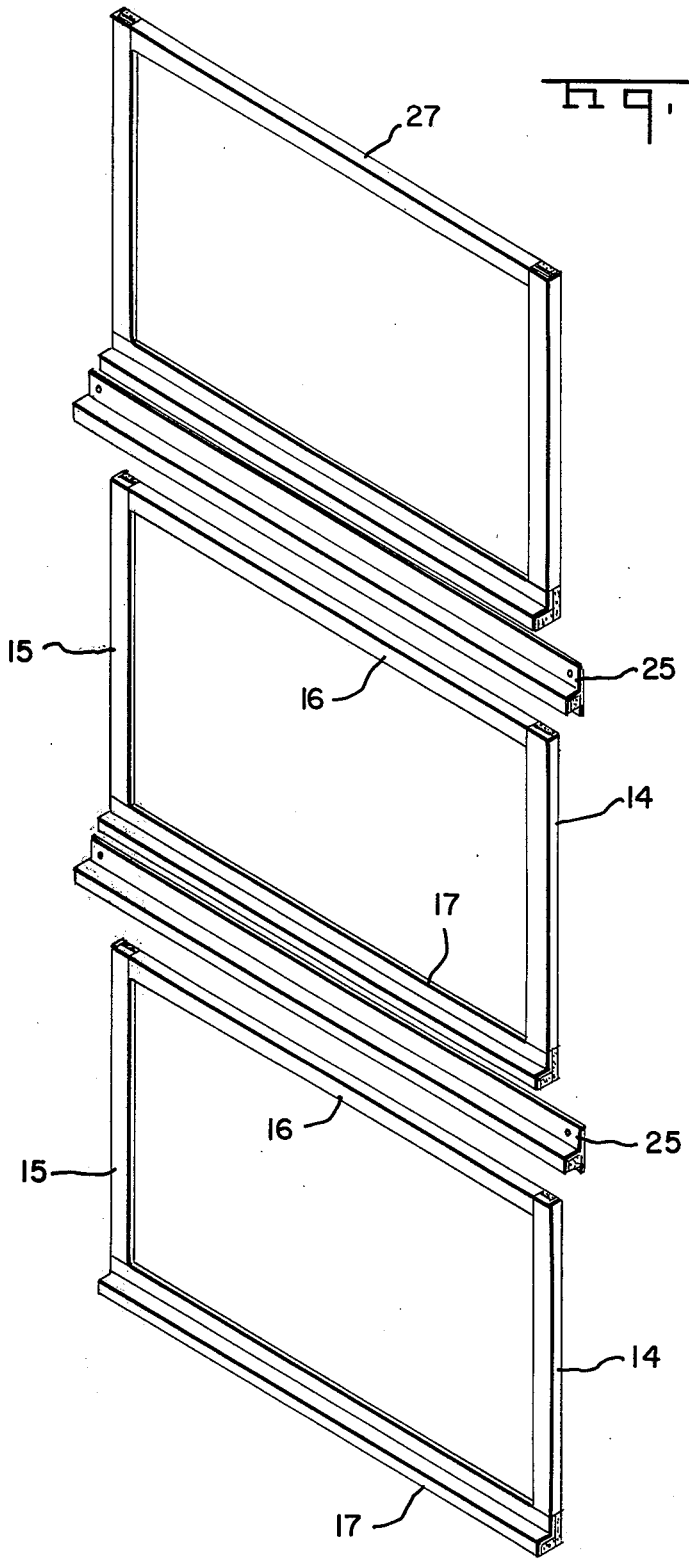
FIG. 10 is an exploded view of a three-panel installation.

FIG. 10 depicts a three panel installation assembled from similar components.

While a particular embodiment of the invention has been shown and described, various modifications are within the true spirit and scope of the invention. The appended claims are intended to cover all such modifications.

What is claimed is:

1. An auxiliary or storm window closure for window frames of various sizes mounted in a wall surface, which frames have diverse transverse and longitudinal dimensions, said closure comprising:

a plurality of parallel, rectangular, transparent panels, each having a length which exceeds the transverse dimension of said frames and a width which is less than the longitudinal dimension of said frames, a plurality of elongated frame members having longitudinal slots which engage the edges of said panels, said frame members being positioned on the sides and along one lengthwise edge of said panels, said frame members including a longitudinal base with a longitudinal portion thereof defining the bottom of each slot, walls extending from said base to define the sides of each slot, gaskets positioned between one of said walls and said window frame to sealingly engage said panels to said frames, a plurality of track members joining adjacent panels along their length to form a sheet, said track members each having a generally flat, longitudinal surface adapted to be placed across said frame and fastened thereto between adjacent panels and having a horizontal slot with an opening facing vertically for receiving an adjacent panel and a gasket receiving slot, gaskets positioned in said gasket receiving slots to sealingly engage the track member to an adjacent panel, and means for attaching said sheet to said frame.

2. The closure recited in claim 1 further comprising:

a sill member having an upwardly facing slot for engaging the edge of one of said panels, said sill member including:

a longitudinal base having a portion thereof defining the bottom of said slot, walls extending from one side of said base to define the sides of said slot, and a lip extending from the other side of said base, and a gasket between the other side of said base and the sill of said window frame.

3. A closure according to claim 1 wherein said panels are constructed of an acrylic plastic.

4. The closure recited in claim 1 wherein said panels are mounted on the inside of said window frame.

5. The method of installing an auxiliary or storm window for window frames of various sizes comprising the following steps:

a. selecting parallel, rectangular, transparent panels each having a length which exceeds the transverse dimension of said frames and a width which is less than the longitudinal dimension of said frames, b. installing on the sides and top of said panels elongated frame members having longitudinal slots which engage the edges of said panels, c. installing gaskets in the frame members along the bottom and both sides of said panels, d. installing one of said panels on the sill of said window, e. placing a track member having a gasket enclosed within slots over the top of the installed window panel and securing said track to said frame, f. installing another panel on top of said installed panel to form a sheet, and g. repeating steps e and f for another panel until the window frame is enclosed with said sheet.

* * * * *